US005277623A

United States Patent [19]

Colleran et al.

[11] Patent Number: 5,277,623

[45] Date of Patent: Jan. 11, 1994

[54] LOW PROFILE PANEL MOUNTABLE RETAINER FOR ELECTRICAL CONNECTORS

[75] Inventors: Stephen A. Colleran, Lisle; Duane M. Fencl, Countryside; Lawrence E. Geib, Bartlett, all of Ill.

[73] Assignee: Molex Incorporated, Lisle, Ill.

[21] Appl. No.: 929,611

[22] Filed: Aug. 13, 1992

[51] Int. Cl.[5] ..... H01R 13/74

[52] U.S. Cl. ..... 439/557; 248/221.4

[58] Field of Search ..... 439/552, 554, 557, 558; 248/221.4

[56] References Cited

U.S. PATENT DOCUMENTS

| | | | |
|---|---|---|---|
| 3,196,380 | 7/1965 | Krehbiel | 439/557 |
| 3,519,978 | 7/1970 | Taormina et al. | 439/596 |
| 3,530,426 | 9/1970 | Snyder, Jr. | 439/557 |
| 3,790,923 | 2/1974 | Mathe | 439/559 |
| 4,114,971 | 9/1978 | Heimbrock | 439/596 |
| 4,687,276 | 8/1987 | Stockmaster | 439/557 |
| 4,813,885 | 3/1989 | Colleran et al. | 439/565 |
| 4,963,098 | 10/1990 | Myer et al. | 439/76 |
| 4,979,910 | 12/1990 | Revil et al. | 439/680 |

OTHER PUBLICATIONS

Molex Drawing 2220 Series "Chassis Mount Header" p. 63E.

*Primary Examiner*—Gary F. Paumen
*Attorney, Agent, or Firm*—Stacey E. Caldwell

[57] ABSTRACT

A low profile panel mountable retainer is provided for mounting an elongated electrical connector in an elongated generally rectangular opening in a panel. The retainer is molded of plastic material and includes an elongated, generally rectangular housing insertable into the panel opening for receiving the connector. The housing has end walls and flexible elongated side walls defining a connector-mounting aperture. A pair of resilient wings extend along the outside of each side wall of the housing. Each pair of wings includes an inner snap-in wing, made up of a plurality of discrete snap-in wing portions, spaced from the respective side wall for passing through the panel opening and for bearing against an opposite side of the panel. Each snap-in wing portion provides a discrete retaining area to assure secure mounting of the retainer to the panel. Each pair of wings also includes an outer stop wing spaced from the respective inner snap-in wing for bearing against an entry side of the panel. A plurality of integral living hinges are positioned along each side wall of the housing to join each inner snap-in wing to the respective side wall and a plurality of integral support beams extend from the hinges to join each outer stop wing to the respective inner snap-in wing. The retainer construction provides a low insertion, high retention connection to the panel.

11 Claims, 2 Drawing Sheets

LOW PROFILE PANEL MOUNTABLE RETAINER FOR ELECTRICAL CONNECTORS

FIELD OF THE INVENTION

This invention generally relates to the art of electrical connectors and, particularly, to a panel mountable retainer for mounting an elongated electrical connector in an elongated opening in a panel or the like.

BACKGROUND OF THE INVENTION

Panel mountable electrical connectors are well known for connecting a wiring harness, or the like, to another electrical device, such as a second electrical connector, in a panel such as a housing or chassis. The second connector may be terminated to another wiring harness, a cable, a circuit board or a second panel. Panel mounted electrical connectors usually include a housing having terminals mounted therein, the housing typically being of nonconductive material which may be partly or entirely molded from plastic. The housing includes a mating end with structure that permits mating and unmating with the second electrical connector.

Heretofore, panel mountable electrical connectors often have been mounted directly to the panel. The mating end of the connector is inserted through an aperture in the panel. Means are provided on the connector housing for achieving secure mounting to the panel. For example, the connector housing may include a flange which exceeds the cross-sectional dimensions of the mounting aperture in the panel. A portion of the connector housing will extend through the mounting aperture and will be engageable with separate retaining means, such as a nut or a clamp engageable against the opposite side of the panel. A portion of the panel therefore will be locked between the flange, the connector housing, and the separate retaining means. In other such panel mountable connectors, integral latch arms or mounting posts on both ends of a connector housing engage the panel, thereby avoiding the need to employ separate panel engaging means with the electrical connector housing. However, this type of structure may not be adequate for an elongated panel mount for several reasons. First, if a short-fill or breakage occurs any where on either latch, the mounting system fails altogether, because both latches are required to fix the retainer on the panel. Second, support on only two sides of an elongated panel mount may not provide adequate rigidity or retention force between the panel mount and the panel, and the panel mount may become dislodged from the panel. Finally, standard latching arms or posts may not fit where there is limited space available because such structures typically require sufficient length for flexibility and deflection. Furthermore, additional apertures may be required in the panel for accommodating such latches or posts.

Another problem with electrical connectors directly mountable to a panel is that many electrical connectors are employed in blind mating environments where precise alignment of the connectors during mating cannot always be ascertained. For example, a panel mountable electrical connector may be disposed at a relative inaccessible location in an automotive vehicle, such as for a radio, in a photostatic copier or in a computer. A failed attempt to align the connector can result in substantial damage to the connector and/or to the fragile electrically conductive terminals mounted therein or to the terminated wiring harness itself. Furthermore, the forces encountered by a technician during an attempt to panel mount an improperly aligned connector can be interpreted by the technician as an indication of complete mounting.

A related problem with panel mountable electrical connectors is that often the insertion force is compromised in order to maximize the retention force and vice versa. That is, in order to make the panel-engaging wings rigid enough to remain firmly in the panel at all times, the insertion force of the connector or retainer will be higher than desirable. Conversely, if the connector latches are made too flexible in order to achieve lower insertion forces, the retention force of the connector within the panel may be less than ideal. It is preferable, therefore, to minimize the insertion force and maximize the retention force of a panel mountable connector within a panel.

In some applications separate panel mounting devices known as clips or retainers have been used. Such a retainer typically includes a housing that can be attached to a panel, for example by snapping or sliding into a locked position in an aperture in the panel. The separate housing is adapted to receive an electrical connector, such as a connector terminated to an end of a wiring harness, either before or after being assembled to the panel.

Heretofore, retainers for panel mountable connectors have been relatively rigid structures which are snapped into place in a panel aperture by using means similar to those used in panel mount connectors, such as stop projections or bosses in combination with snap latch flanges provided on opposite side walls of the relatively rigid retainer. Such retainers, although allowing replaceability of the connectors themselves, have the same disadvantages outlined above in mounting a connector directly to a panel, particularly in blind mating environments. In such environments, it is desirable to not only provide a low insertion force/high retention force retainer, but also to design the retainers such that there is "float" within the panel to allow for alignment of a complementary connector upon mating to the retainer/connector assembly. This requires flexibility and tolerance accommodation in the retainer structure. These desirable attributes are particularly advantageous with significantly elongated connectors where a number of mating pins must be accurately aligned.

This invention is directed to solving various problems encountered with panel mountable electrical connectors, some of which have been outlined above, by providing a panel mountable retainer of an improved structure and which is particularly applicable for mounting an elongated connector in a panel.

SUMMARY OF THE INVENTION

An object, therefore, of the invention is to provide a new and improved panel mountable retainer for mounting an elongated electrical connector in an elongated opening in a panel.

In the exemplary embodiment of the invention, the retainer is molded of plastic material and includes an elongated, generally rectangular housing for receiving an elongated electrical connector insertable into the elongated panel opening. The housing has relatively short end walls and flexible elongated side walls that can float relative to the panel, the end and side walls defining a connector receiving aperture. A pair of resilient wings extend along the outside of each sidewall of the housing. Each pair of wings includes an inner snap-in wing, made up of multiple snap-in wing portions, spaced from the respective side wall for passing through the panel opening and for bearing against the opposite side of the panel, and an outer stop wing spaced from the inner snap-in ring for bearing against an entry side of the panel. No extra pieces are required. The multiple snap-in wing portions provide distinct panel mounting areas to assure secure mounting of the retainer to the panel. Therefore, if any one snap-in wing portion becomes non-functional, for example by short fill or breakage, adequate retention is still provided by the remaining portions. In addition, since both the inner and outer wings extend along the outside of each sidewall of the housing, support is provided along the entire length of the retainer. This becomes increasingly important as the connector becomes longer. Further, the location of the wings adjacent the respective sidewalls of the housing result in space savings with respect to overall retainer height. The limiting height becomes the housing body because the wings are contained within the housing dimensions of the body. Such a low profile design is particularly important in some of todays applications where electronic packages are becoming much smaller.

The invention further contemplates that a plurality of integral hinges be provided along each elongated side wall of the housing. The hinges join the inner snap-in wing to the respective side wall of the housing and continue outwardly in the form of support beams to join the outer stop wing to the inner snap-in wing. Spaces created between the individual hinges and support beams, and between the inner snap-in wing and the outer stop wing produce a lattice-like structure which reduces the stiffness of the mounting arms and result in increased flexibility of the wings. However, the location and presence of the support beams prevents too much flexibility which could result in inadequate retention of the retainer within the panel. A connector may be preassembled into the retainer prior to being mounted to the panel, or the retainer alone may be inserted into the panel prior to inserting the connector assembly into the retainer. In either case, the ultimate result of the overall flexibility of the wing construction is that the insertion force of the retainer or retainer and connector is very low, yet the retention force to the board is quite high. The high retention forces are necessary for blind mating conditions where forces may push a retainer or connector out of a panel.

In addition, the design allows for blind mating of, for example, a printed circuit board header to the panel by providing "float" between both the housing and retainer and the retainer and panel. This "float", i.e. self-alignment of mating connectors by tolerance accommodation, facilitates complete mating of the connectors and prevents damage that may occur to the housing, terminals or panel when attempting to forcibly blind mate improperly aligned connectors. Furthermore, to prevent inadvertent connections or mistakes in assembly, both the retainer and housing are polarized to their respective mounting apertures.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
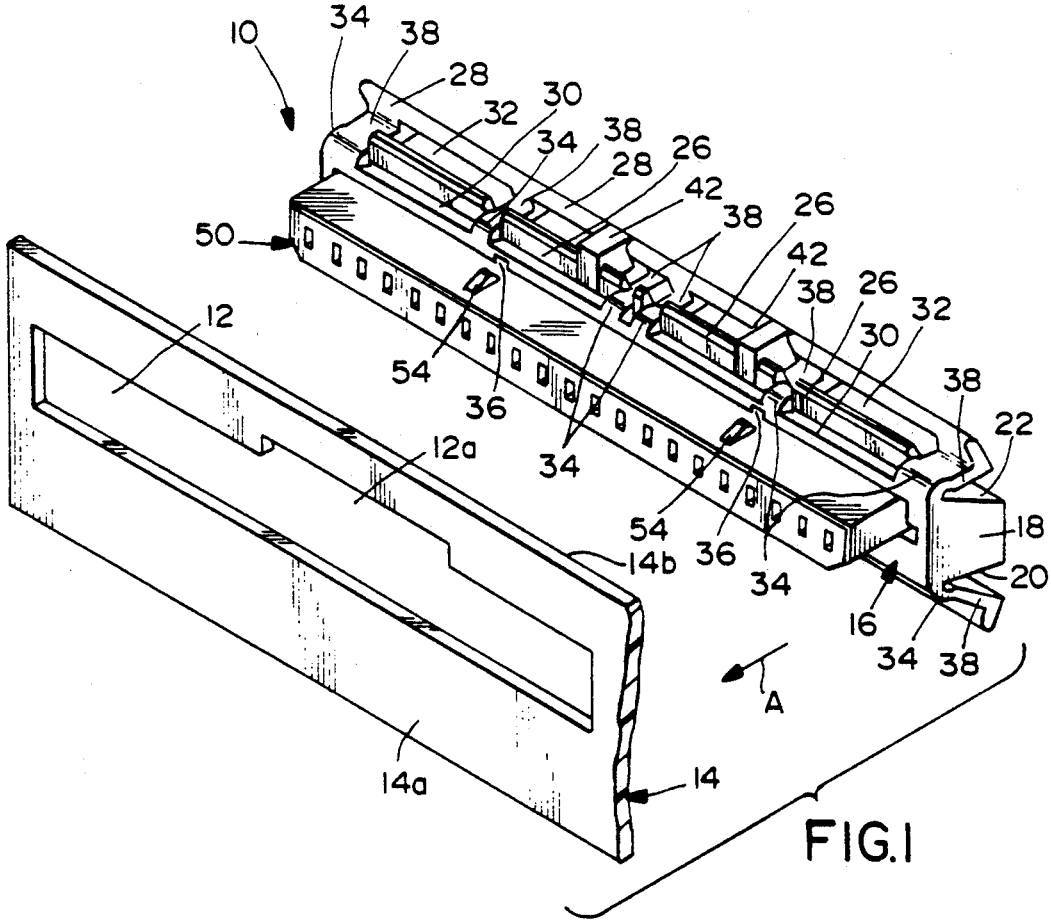
FIG. 1 is an exploded perspective view of the panel-mounted retainer of the invention, with a connector inserted therein, spaced from a panel having an opening for receiving the retainer/connector assembly.

Referring to the drawings in greater detail, and first to FIG. 1, the invention is embodied in a panel mountable retainer, generally designated 10, for mounting an elongated electrical connector (described hereinafter) in an elongated, generally rectangular opening 12 in a panel, generally designated 14. The panel has a front side **14*a* and a back or entry side 14*b*. Retainer 10 is inserted into opening 12 in the direction of arrow "A". The panel may be part of a housing, chassis or other support structure, and the retainer is particularly useful in applications where a connector is to be "blind" mounted in the panel. In other words, the panel may be part of a chassis in an automotive vehicle, a photostatic copier, a computer or the like, wherein back side 14*b* of the panel is at a relatively inaccessible location. In such environments, the retainer can be inserted and locked in place within the panel opening prior to inserting a connector into the already positioned retainer. Alternatively, the connector can be preassembled into the retainer, and the entire assembly can be inserted into the panel opening. Lastly, for purposes to be described hereinafter, opening 12 in the panel has a cut-out portion 12*a*** in one side or edge thereof.

Figure 2:
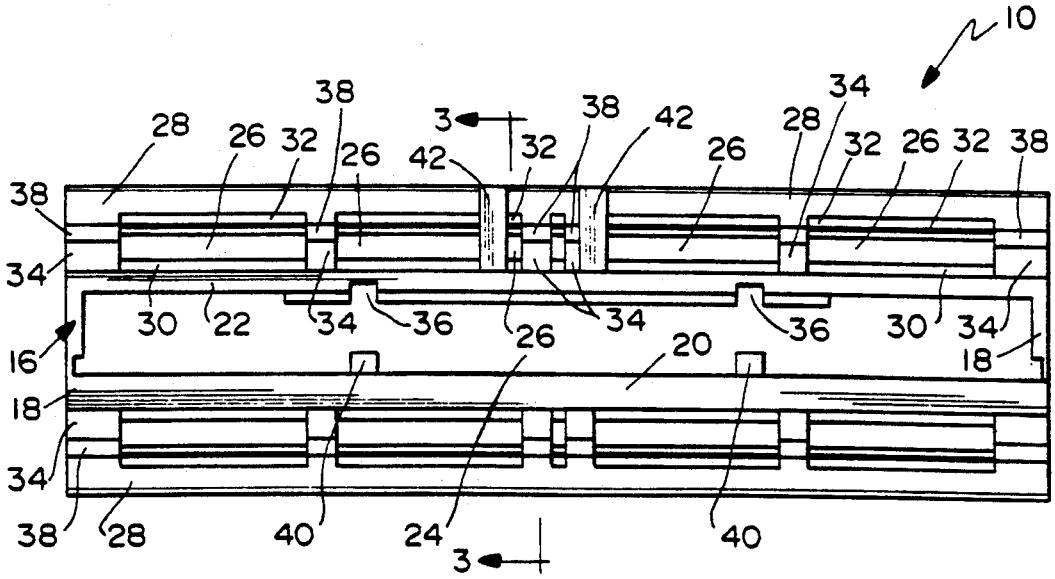
FIG. 2 is a front elevational view, on an enlarged scale, of the retainer.
Figure 3:
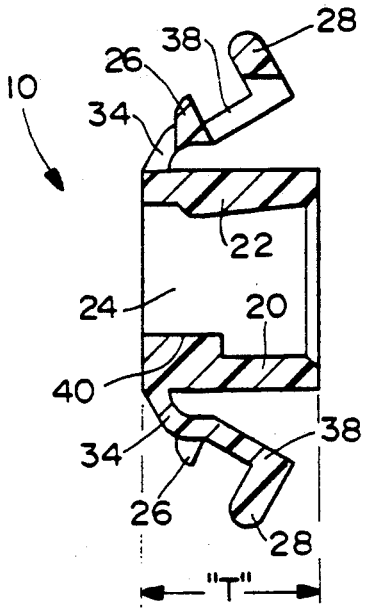
FIG. 3 is a vertical section taken generally along line 3—3 of FIG. 2.

Referring to FIGS. 2 and 3 in conjunction with FIG. 1, retainer 10 includes an elongated, generally rectangular housing, generally designated 16, defined by relatively short end walls 18 and elongated flexible side walls 20 and 22. The end and side walls define an elongated, generally rectangular aperture 24 through which an electrical connector is insertable, as described hereinafter.

Generally, a pair of elongated resilient wings extend along the outside of each side wall 20 and 22 of housing 16. Each pair of wings include an inner snap-in wing which, in the disclosed embodiment, is defined by a plurality of discrete snap-in wing portions 26, and an outer stop wing 28. The inner snap-in wing includes an area of reduced thickness separating each adjacent pair of discrete snap-in wing portions. Snap-in wing portions 26 are spaced from the respective side wall, as indicated by spacing 30. Each snap-in wing portion 26 provides a discrete retaining area to assure secure mounting of the retainer to the panel. Therefore, if any one snap-in wing portion becomes non-functional, for example, by short-fill or breakage adequate retention is still provided by the remaining portions. Each outer stop wing 28 is spaced from the inner snap-in wing portions, as indicated by spacing 32. Therefore, the inner snap-in wing (defined by wing portions 26) runs generally parallel to the respective housing side wall 20 or 22 in a spaced relationship thereto, and each outer stop wing 30 runs parallel to the respective inner snap-in wing in a spaced relationship relative thereto. The pairs of wings run along the retainer substantially entirely the length of housing 16 and the side walls thereof. As a result, support is provided along the entire length of the retainer. This is important in the use of elongated connectors or structures where support only on the two shorter ends may not provide adequate retention force within the panel.

Retainer 16 is fabricated as a one-piece component molded of dielectric material such as plastic or the like. Nylon has been used in actual practice. The invention contemplates that a plurality of integral living hinges 34 be spaced longitudinally of each side wall 20 and 22 of housing 16 for joining each inner snap-in wing to the respective side wall and a plurality of integral support beams 38 be similarly spaced for joining each outer stop wing 28 to the respective inner snap-in wing. In other words, as seen in FIGS. 2 and 3, the integrally molded living hinges 34 project outwardly from the side walls to the inner wing, spanning spacing 30 between the inner wings and the housing side walls, and integrally molded support beams 38 project outwardly from the hinges spanning spacings 32 between the inner and outer wings. As is seen in FIG. 3, the wings are molded adjacent the housing sidewalls 20 and 22 and are dimensioned to be contained within the thickness dimension, designated by arrows "T" in FIG. 3 of housing 18. This provides the retainer with an overall low profile, due to the fact that extra space is not taken up by horizontal deflection requirements of the retention area of conventional panel mount latches.

As seen in FIG. 2, for purposes described hereinafter, polarizing notches 36 are formed in the inner edge of side wall 22, and latch ridge 40 is formed in the inner edge of side wall 20. The polarizing notches are provided for polarizing the insertion of an electrical connector into aperture 24 of the retainer. Latch ridge 40 is provided for latching a connector in the retainer.

Lastly, a pair of polarizing ribs 42 project outwardly from side wall 22 of the retainer housing for polarizing the retainer in panel opening 12. These ribs move into cut-out area **12*a* of opening 12** when the retainer is inserted into the panel opening. It can be seen that the cut-out area is to one side of the longitudinal center of the opening.

Figure 4:
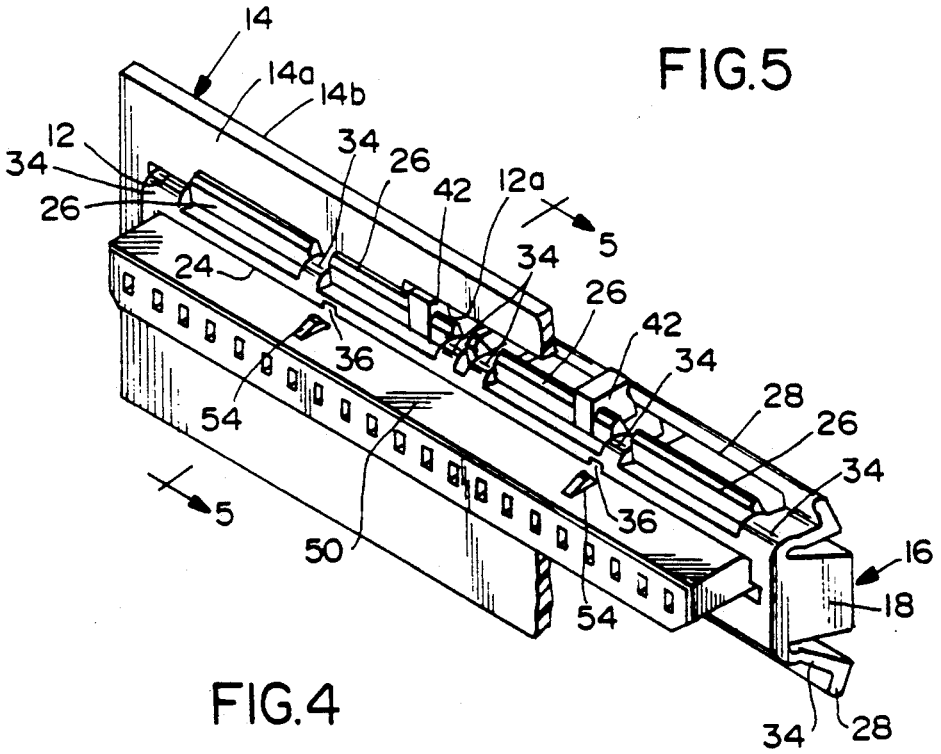
FIG. 4 is a perspective view, with the panel cutaway, of the retainer inserted into the panel opening, along with a connector inserted into the retainer.

In the preferred embodiment of the invention, connector 50 is preassembled into retainer 10, and retainer 10 is mounted in panel opening 12 in the direction of arrow "A" (FIG. 1). When so mounted, and referring to FIGS. 4 and 5, the inner snap-wings (defined by wing portions 26) bear against front side **14*a* of panel 14. Outer stop wings 28 bear against the back or entry side 14*b* of the panel. At this point, it should be noted that by providing separate discrete living hinges 34 and support beams 38 spaced at intervals along the length of the elongated retainer, considerable resiliency is afforded the side walls as well as the wings which are spaced from the side walls and from each other. This is in contrast to having an integral hinge portion and support beam along the entire length of the retainer, i.e. having the inner wings continuously joined to the side walls and the outer wings continuously joined to the inner wings. Yet, the hinges and support beams provide relative positional support for the side walls and the wings, in view of the fact that all of these features are relatively thin and fabricated of plastic material. For example, the retainer, in one embodiment, may be fabricated of nylon material and be on the order of only 1.5 inches long. The side walls of the retainer housing may be on the order of only 0.04 inch thick, with similar thicknesses for the wings themselves. Therefore, the side walls and the wings provide considerable flexibility in the elongated structure for facilitating insertion into panel opening 12, yet living hinges 34 provide ample support of the relative positional relationships between the wings and the respective side walls to maximize retention of the retainer within the panel. It should be further noted that the spacing 52 between the top and bottom of the connector and the adjacent sides of aperture 24 of the retainer may be somewhat exaggerated in the depiction of the drawings. However, the flexibility of the retainer and the relatively loose fit of the retainer longitudinally within the panel cut-out 12**, does provide the retainer/-connector assembly with a floating action to facilitate blind insertion of a mating connector.

Figure 5:
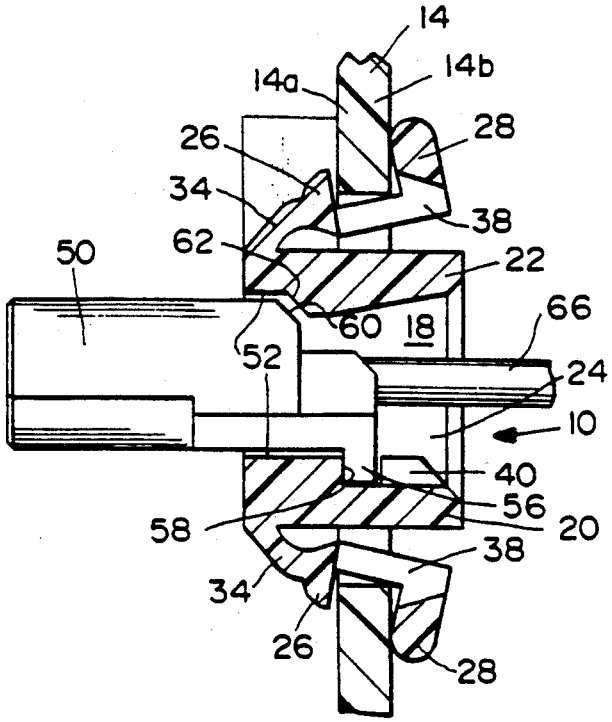
FIG. 5 is a vertical section, on an enlarged scale, taken generally along line 5—5 of FIG. 4.

As stated above, polarizing notches 36 (FIGS. 1 and 2) are provided in the top edge of aperture 24. It can be seen in FIGS. 1 and 4 that the top of connector 50 includes a pair of polarizing bosses 54 which correspond to notches 36. FIG. 5 also shows latch ridge 40 within retainer aperture 24. It can be seen that connector 50 has a latch flange 56 which snaps behind this latch ridge and abuts against a shoulder 58 to secure the connector within the retainer. A chamfered corner 60 of the connector also is located behind a chamfered surface 62 within the retainer aperture.

Lastly, FIG. 5 shows connector 50 (mounted within retainer 10) extending through opening 12 of panel 14 to allow interfacing with any of a variety of mating electrical devices. It can be seen that connector 50 is terminated to an electrical cable 66 which also can comprise an electrical harness or have other wiring configurations. Here again the low profile design of the retainer allows a mating connector (not shown), for example, terminated to a second cable or mounted to a second panel, to the placed in close proximity to panel 14 and retainer 10, thereby resulting in space savings over conventional latch designs.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A generally rectangular panel mountable housing adapted to be inserted and retained within an opening in a panel, said housing including two generally parallel, elongated sides having a given height in the direction of insertion of the housing into the panel, and a resilient panel mounting wing extending along each elongated side, each wing having an outer stop wing spaced from and formed parallel to the side adapted to be positioned on a first side of the opening, and an inner snap-in wing intermediate of and parallel to the outer stop wing and said side and adapted to be positioned on an opposite side of the opening, the improvement in each wing comprising:

the inner snap-in wing includes a plurality of discrete snap-in portions which define discrete panel mounting areas along substantially the entire length of the elongated sides of the housing, an area of reduced thickness of the inner snap-in wing separating each adjacent pair of said discrete snap-in wing portions; and a plurality of spaced-apart joints which join the panel mounting wing to the elongated side of the connector, whereby the spaces between the joints provide flexibility between each snap-in wing portion and its respective elongated side to yield a low insertion connection of the housing to the panel.

2. The panel mountable housing as set forth in claim 1 further comprising a plurality of spaced-apart support beams extending between each outer stop wing and each inner snap-in wing, the spaces between the support beams providing additional flexibility within each panel mounting wing.

3. The panel mountable housing as set forth in claim 1 wherein at least one spaced-apart joint is positioned between two discrete snap-in portions.

4. In a panel mountable housing as set forth in claim 2, wherein each of said support beams is located in-line with each joint.

5. In a panel mountable element as set forth in claim 1, wherein said housing defines a panel mountable retainer, the retainer having an aperture adapted to receive an electrical connector therein.

6. In a panel mountable housing as set forth in claim 5, including polarizing means between the retainer and the panel.

7. In a panel mountable housing as set forth in claim 6, wherein said polarizing means comprise a cut-out area on one side of the opening in the panel and a polarizing projection on one of the sides of the retainer.

8. In a panel mountable housing as set forth in claim 5, including polarizing means between the retainer and the connector.

9. In a panel mountable housing as set forth in claim 8, wherein said connector polarizing means comprise at least one notch in at least one side of the retainer and a corresponding projection on the connector.

10. In a panel mountable housing as set forth in claim 5, including connector latch means on the retainer to secure the connector within the retainer comprising a latch ridge on one of the sides projecting into the connector-receiving aperture.

11. In a panel mountable housing as set forth in claim 1, wherein said resilient wings are dimensioned to lie within the given height of the housing.

* * * * *